United States Patent [19]

Booth et al.

[11] 4,091,983

[45] May 30, 1978

[54] BULK CONTAINER WITH PARTIAL BELLOWS BOTTOM

[75] Inventors: Vernard S. Booth; Billy W. Oswalt, both of Albany, Ga.

[73] Assignee: Olinkraft, Inc., West Monroe, La.

[21] Appl. No.: 791,713

[22] Filed: Apr. 28, 1977

Related U.S. Application Data

[60] Division of Ser. No. 701,577, Jul. 1, 1976, which is a continuation-in-part of Ser. No. 694,756, Jun. 10, 1976, Pat. No. 4,046,307.

[51] Int. Cl.[2] ..... B65D 3/24; B65D 5/48

[52] U.S. Cl. ..... 229/15; 229/37 R

[58] Field of Search ..... 229/15, 37 R, 38, 17 G

[56] References Cited

U.S. PATENT DOCUMENTS

| | | | |
|---|---|---|---|
| 2,390,909 | 12/1945 | Zimm, Jr. | 229/17 G X |
| 2,478,359 | 8/1949 | Ball | 229/38 |
| 3,066,842 | 12/1962 | Croley | 229/7 |
| 3,227,353 | 1/1966 | Bump | 229/17 G |
| 3,501,081 | 3/1970 | Paige | 229/37 R X |
| 3,633,794 | 1/1972 | Croley | 222/88 |
| 3,701,466 | 10/1972 | Woodrow et al. | 229/15 X |
| 3,904,105 | 9/1975 | Booth | 229/15 |

*Primary Examiner*—Davis T. Moorhead
*Attorney, Agent, or Firm*—O'Brien & Marks

[57] ABSTRACT

A bulk container with at least one cell has partial bellows corners formed at two adjacent bottom corners by three bottom panels hinged on three adjacent walls, and has a fourth bottom panel hinged on the bottom edge of the wall between the other two corners of the cell free of the three bottom panels and sandwiched between the intermediate panel of the three bottom panels and fold-in portions defined by partial diagonal score lines and cuts in the two side bottom panels of the three bottom panels.

7 Claims, 11 Drawing Figures

FIG. 1
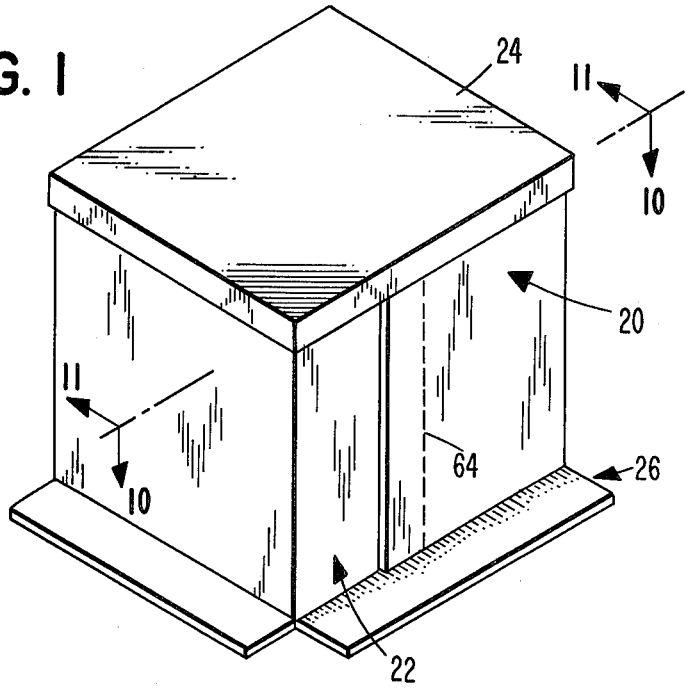
FIG. 2
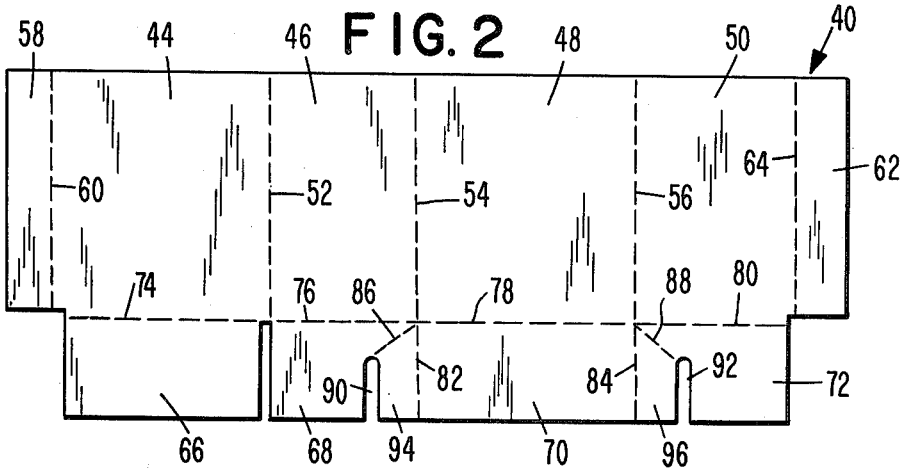
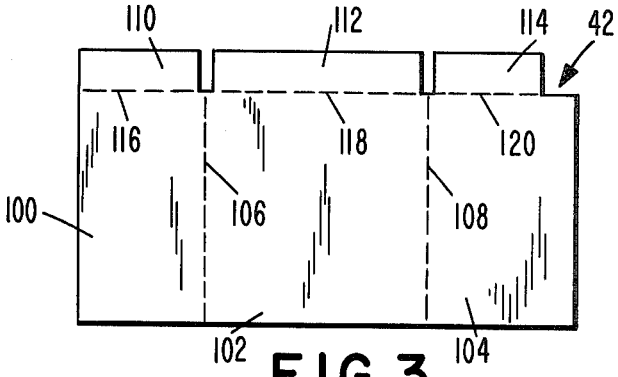
FIG. 3
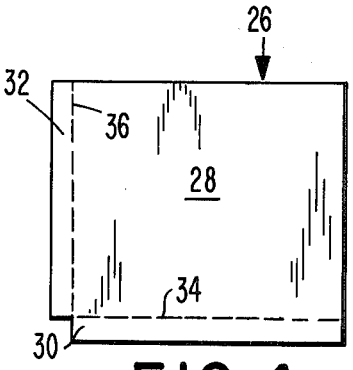
FIG. 4

BULK CONTAINER WITH PARTIAL BELLOWS BOTTOM

CROSS REFERENCE TO RELATED APPLICATION

This application is a division of our copending U.S. application Ser. No. 701,577 filed July 1, 1976 which is a continuation-in-part of our copending U.S. application Ser. No. 694,756 filed June 10, 1976 now U.S. Pat. No. 4,046,307. These copending applications are incorporated herein by reference.

BACKGROUND OF THE INVENTION

1. Field of the Invention

This invention relates to containers for bulk materials such as peanuts and the like.

2. Description of the Prior Art

Paperboard containers are often used for shipping and storing bulk materials due to the light weight and low cost of such containers as well as their capability of being knocked down or folded when empty in a minimum of space. The prior art, as exemplified in U.S. Pat. Nos. 3,425,615, 3,543,991, and 3,904,105, contains bulk material containers having a plurality of vertical cells or rectangular tubes laminated together in a double thickness to produce containers with increased capability of withstanding stacking and bulging forces during storage or shipment. Also the prior art, as exemplified in U.S. Pat. Nos. 3,066,842, 3,633,794, 3,701,466, and 3,715,072, contains bulk material containers having multi cells formed by tubular liners enclosed in an outer box or jacket. Other types of containers, such as are disclosed in U.S. Pat. Nos. 3,347,446, and 3,404,806, have employed center petitions or center reinforcing panels.

Various types of bottoms have been employed in the prior two-cell bulk containers including (1) bottom trays or caps such as those disclosed in the above-mentioned U.S. Pat. Nos. 3,543,991 and 3,904,105, (2) slotted or separate bottom flaps such as those disclosed in the above-mentioned U.S. Pat. Nos. 3,701,466 and 3,715,072 and (3) trapezoidal bottom flaps integrally joined by triangular infold sections such as those disclosed in the above-mentioned U.S. Pat. Nos. 3,633,794 and 3,066,842. The bottom trays require an additional member which must be made; the slotted bottom flaps tend to tear or round out at the outer corners; and full bellows bottoms such as trapezoidal panels integrally joined by triangular infold sections produce a springy fold build-up.

A paper container disclosed in U.S. Pat. No. 2,48,359 has foldable bottom-forming sections with diagonal score lines extending from corners to slots or cutouts to form an inward folding triangular corner piece to produce a liquid tight bottom for the container. U.S. Pat. No. 3,378,137 discloses a display carton wherein the top thereof, has two side or gusset flaps with diagonal creases cooperating with V-shaped notches to make a bellows fold; a primary flap being separate from the other flaps so that only two of the top four corners are formed with gusset flaps. Such liquid paper containers and display cartons generally are not applicable to bulk material containers each for containing a large quantity of bulk material such as a ton of peanuts.

SUMMARY OF THE INVENTION

The invention is summarized in a bottom for a bulk container having at least one cell with four side walls circumscribing the one cell, the bottom including three bottom panels hinged at horizontal score lines on the bottom edges of three of the four walls forming an end bottom panel and two side bottom panels on opposite sides of the end bottom panel, the two side bottom panels of the three bottom panels being hinged to the opposite sides of the end bottom panel of the three bottom panels by a vertical score lines, the two side bottom panels having respective partial diagonal score lines extending at one end from the respective corners defined by the vertical and horizontal score lines, the two side bottom panels further having respective cuts extending from the distal edges of the side bottom panels to the other ends of the partial diagonal score lines such as to form partial bellows corners at the bottom end of the bulk container, a fourth bottom panel hinged on the bottom edge of the fourth side wall and free of the three bottom panels, and the fourth bottom panel being sandwiched between the end bottom panel and fold-in portions defined by the partial diagonal score lines and cuts with the end bottom panel on top of the fourth bottom panel as the container sits upright. An object of the invention is to construct a container having increased strength and resistance to distortion when filled and stacked.

Another object of the invention is to prevent tearing and rounding of the outside corners of a bulk container.

One advantage of the invention is that partial bellows corners on the outside bottom corners of the two-cell container reinforce the corners without substantial springy fold buildup.

One additional feature of the invention is the use of a flap on a fourth wall of one cell to be gripped within the partial bellows fold formed only at two corners to strengthen the bottom of the container.

Other objects, advantages and features of the invention will be apparent from the following description taken in conjunction with the accompanying drawings.

BRIEF DESCRIPTION OF THE DRAWINGS

FIG. 1 is a perspective view of a two-cell bulk material container in accordance with the invention.

FIG. 2 is a plan view of a blank for forming a sleeve in one cell of the container of FIG. 1.

FIG. 3 is a plan view of a blank for forming a liner of one cell of the container of FIG. 1.

FIG. 4 is a plan view of a slip sheet for the container of FIG. 1.

DESCRIPTION OF THE PREFERRED EMBODIMENT

Figure 5:
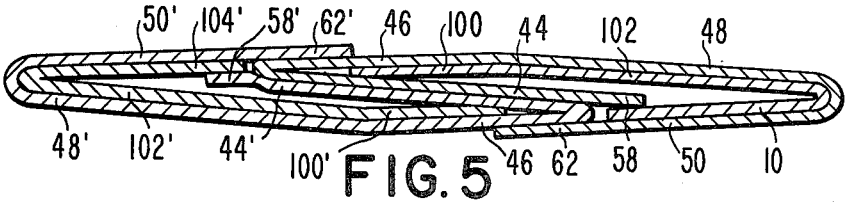
FIG. 5 is a horizontal cross-section view of the assembled blanks of FIGS. 2 and 3 in a folded or flat condition.
Figure 6:
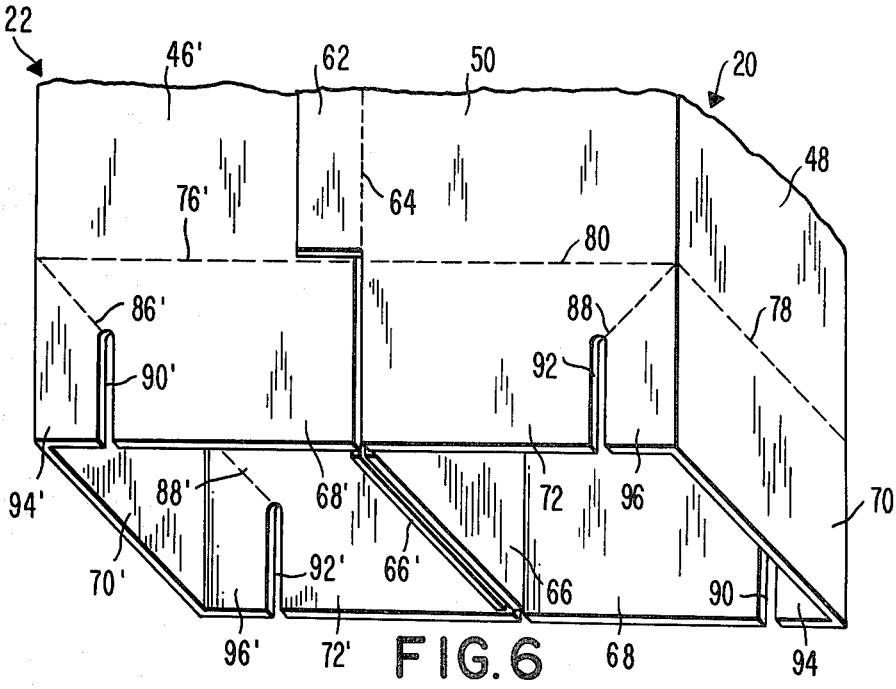
FIG. 6 is a perspective view of a bottom portion of the body of the container of FIG. 1 in an unfolded condition but with the bottom in an unassembled state.
Figure 7:
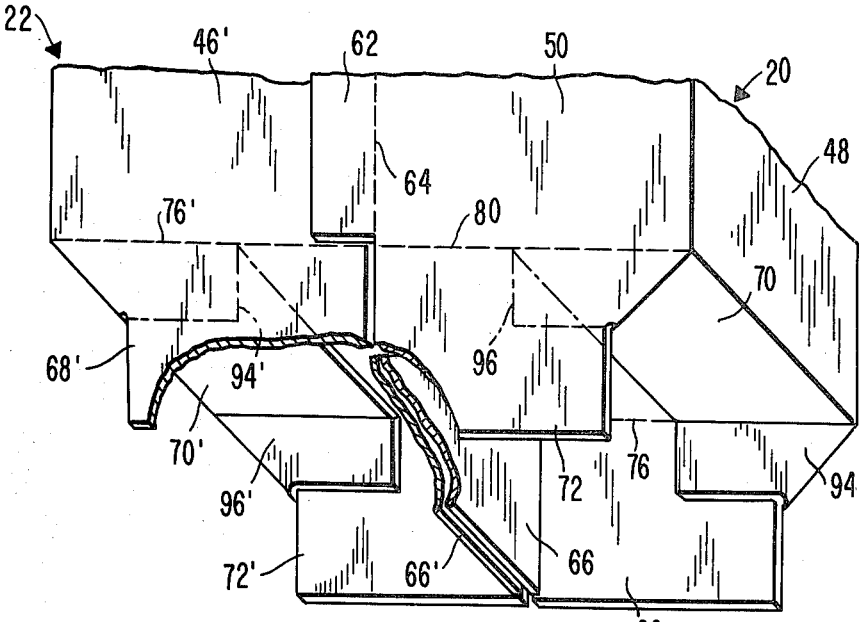
FIG. 7 is a view similar to FIG. 6 but at a second step in the assembly of the bottom for the container body.

As illustrated in FIG. 1, the invention is embodied in a bulk material container including a body formed by two cells indicated generally at 20 and 22, top closing means such as a top cap 24, and a bottom support means such as a slip sheet indicated generally at 26. The top cap 24 is a conventional top cap utilized in prior art bulk material containers but could be replaced by any other top closing lip or arrangement. The slip sheet 26, as shown in FIG. 4, is formed from a paperboard blank and includes a panel 28, corresponding to the bottom of the body of the container, with two flaps 30 and 32 hinged at respective score lines 34 and 36 on respective front and side edges of the panel 28; other conventional bottom supports, such as pallets, bottom caps, or the like, could be used in addition or in place of the slip sheet 26.

Figure 10:
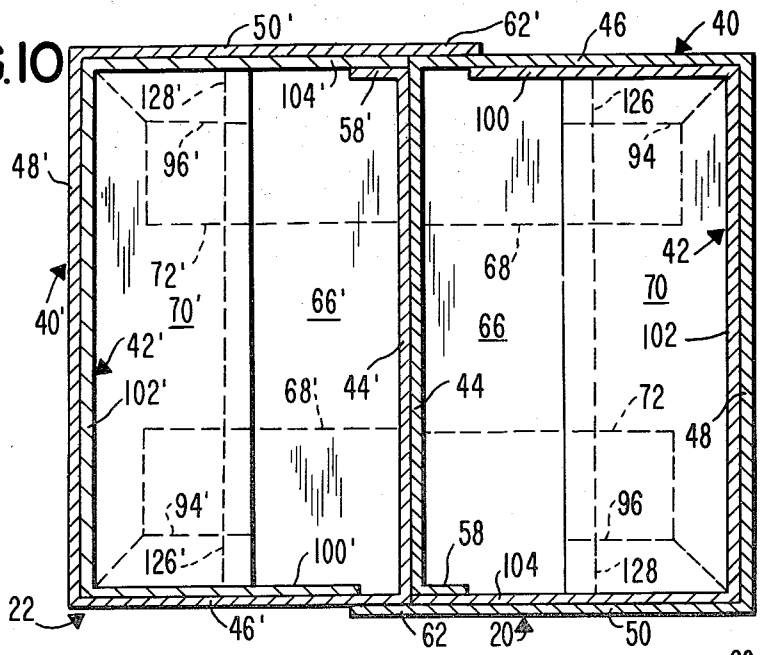
FIG. 10 is a horizontal cross-sectional view taken as indicated at 10—10 in FIG. 1.

The cell 20 of the container body, as shown in FIG. 10, is rectangular with four side walls and is formed from a sleeve indicated generally at 40 and a liner indicated generally at 42 forming the four side walls of the cell 20.

Figure 8:
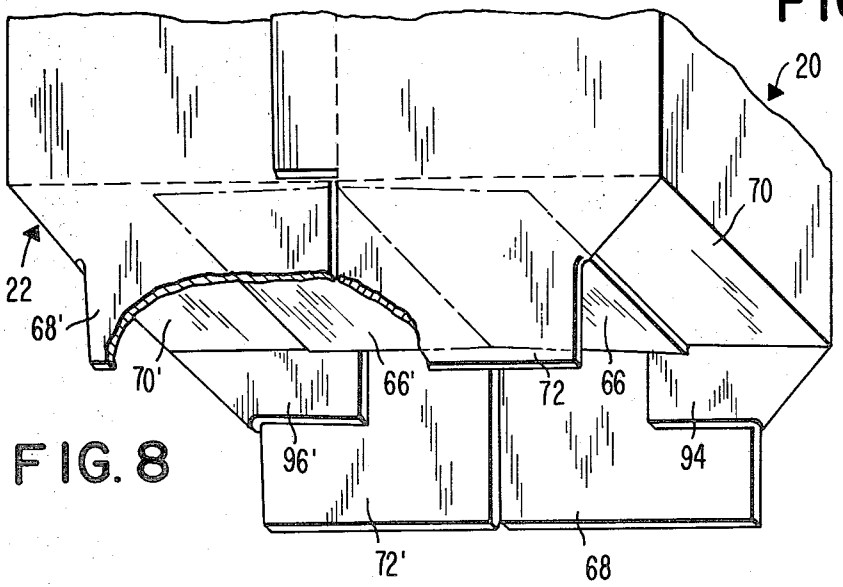
FIG. 8 is a view similar to the FIGS. 6 and 7, but at a still later step in the assembly of the bottom of the container body.
Figure 9:
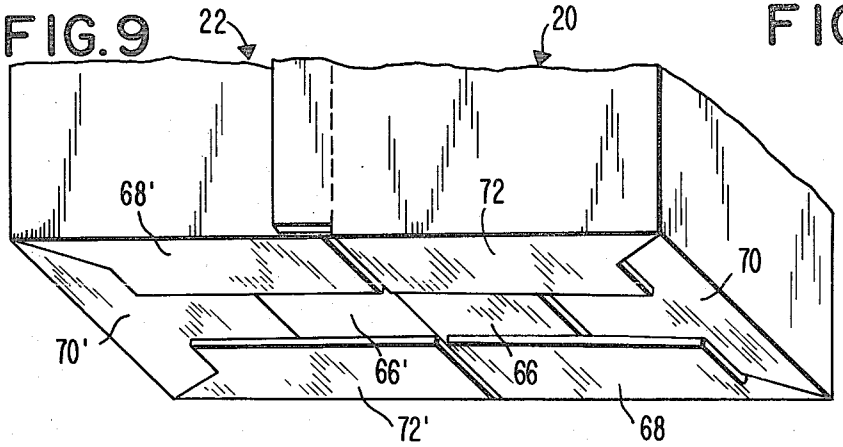
FIG. 9 is a view similar to FIGS. 6, 7, and 8, but after completion of the assembly of the bottom of the container body

The sleeve 40 is formed from a corrugated paperboard blank shown in FIG. 2 and includes four wall panels 44, 46, 48 and 50 serially hinged together by a vertical score line 52 between the panels 44 and 46, a vertical score line 54 between the panels 46 and 48, and a vertical score line 56 between the panels 48 and 50. An inside joint flap 58 is integrally hinged at a score line 60 on the panel 44 at one end of the sleeve wall panels while an outside joint flap 62 is hinged at a reverse score line 64, on the panel 50 at the other end of the sleeve wall panels. Hinged at horizontal score lines 74, 76, 78 and 80 on the bottom edges of the respective panels 44, 46, 48 and 50 are bottom panels 66, 68, 70 and 72. Side bottom panels 68 and 72 are joined at respective vertical score lines 82 and 84 to the opposite side edges of the end bottom panel 70 and have respective partial diagonal score lines 86 and 88 extending less than 40 percent of the distance across the width (vertical dimension as shown in FIG. 2) of the side bottom panels 68 and 72 from the corners formed by the vertical score lines 54 and 56 with the horizontal score lines 76 and 80. The other ends of the partial diagonal score lines 86 and 88 terminate in cuts 90 and 92 formed in the respective panels 68 and 72 from the distal inside edges of the bottom panels extending parallel to the score lines 82 and 84 across more than 60 percent of the width of the side bottom panels 68 and 72. The panel 66 is cut away at its opposite side edges to form a free flap of sufficient size to extend between fold-in portions 94 and 96 formed by the diagonal score lines 86 and 88 and cuts 90 and 92 after the end panel 70 has been folded to a horizontal position, as shown in FIG. 8.

Figure 11:
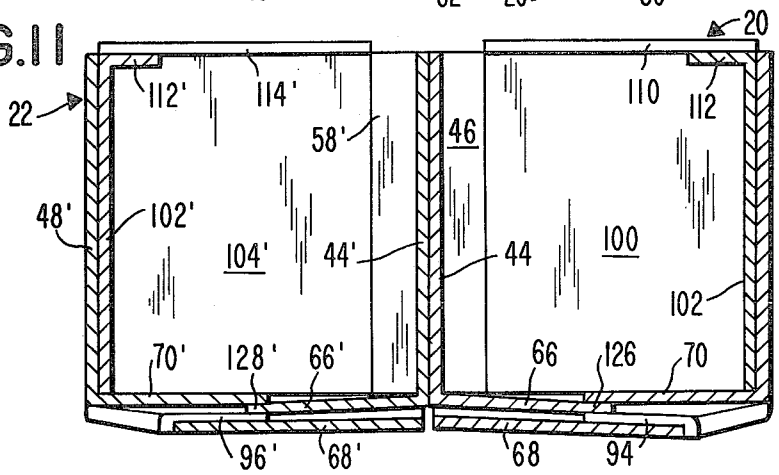
FIG. 11 is an elevation cross-sectional view taken as indicated at 11—11 in FIG. 1.

The liner 42 is formed from a corrugated paperboard blank illustrated in FIG. 3 and includes a series for three wall panels 100, 102 and 104 wherein the panels 100 and 102 are hinged together at a vertical score line 106 and the panels 102 and 104 are hinged together at a vertical score line 108. On the top edges of the respective panels 100, 102 and 104, top flaps 110, 112 and 114 are hinged at score lines 116, 118 and 120. As shown in FIGS. 5, 10 and 11, the liner wall panels 100, 102 and 104 are bonded to the inside surfaces of the respective sleeve wall panels 46, 48 and 50 by an adhesive or the like to form three outside walls of the cell 20 hinged together at vertical score lines or outside corners defining an end wall between the vertical outside corners of the container body. The inside joint flap 58 is bonded to the inside surface of the liner panel 104 to form a rectangular tubular structure with double thickness outside walls from the laminated wall panels.

The cell 22 is identical to the cell 20, except for a 180° rotation, and the corresponding parts of the cell 22 are identified by the same numerals as used in cell 20 except for the addition of a prime symbol (′). The wall panels 44 and 44′ of the sleeves 40 and 40′ of the respective cells 20 and 22 are bonded together face to face by an adhesive or the like to form a common wall between the two cells 20 and 22 or a fourth wall of the cell 20. The side edge portions of the wall panels 44 and 44′ adjacent to the respective wall panels 46 and 46′ are offset by the thickness of the liner panels 104′ and 104 to extend over the edges of the panels 104′ and 104 of the respective opposite cell; the liner panels 104 and 104′ have a width (horizontal dimension as shown in FIGS. 10 and 11) selected so that their edges generally abut the offset edge portions of the panels 44′ and 44. The exterior joint flaps 62 and 62′ extend across the opposite side edges of the joined panels 44 and 44′, or bridge the abutments between the panels 104 and 46′ and 104′ and 46, and are joined by suitable means such as adhesive to the outside surface of the panels 46′ and 46 of the respective opposite cells. The sleeves 40 and 40′ and the liners 42 and 42′ can all conveniently be bonded together in the flat condition illustrated in FIG. 5.

The bottom panels and flaps of both cells are assembled as shown in FIGS. 6–11. First the outside end bottom panels 70 and 70′ are folded inward to a horizontal position to also fold the fold-in portions 94, 96, 94′ and 96′ about the partial diagonal score lines 86, 88 and 86′ and 88′ to extend the fold-in portions 94, 96, and 94′ and 96′ along the inside of the remaining portions of the side bottom panels 68, 72, 68′ and 72′. Then the free fourth or center bottom panels 66 and 66′ are folded horizontally to overlap the respective panels 70 and 70′ with the panels 66 and 66′ positioned between the fold-in portions 94, 96, 94′ and 96′, respectively. Finally the side bottom panels 68, 72, 68′ and 72′ are folded inwardly to a horizontal position to also fold the fold-in portions 94, 96, 94′ and 96′ to a horizontal position sandwiching the bottom panels 66 and 66′ between the end bottom panels 70 and 70′ and the fold-in portions 94, 96, 94′ and 96′ with the end bottom panels 70 and 70′ being on top when the container is upright.

The fold-in portions 94, 96, and 94′ and 96′ produce a partial bellows bottom which substantially reinforces the outside corners of the two-cell container body to resist tearing of the outside corners of the container beginning at the bottom as well as to reduce the tendency for the outside corners of the container to round out when the box is filled with a large quantity of bulk material. Further the partial bellows bottom wherein the diagonal score lines 86, 88 86′ and 88′ are formed less than 40 percent of the width across the bottom panels 68, 72 and 68′ and 72′ substantially eliminates any springy fold buildup that generally accompanies a full bellows bottom or one that extends to a substantially greater distance across the bottom panel.

Also it is noted that outer corner portions 126, 128, 126′ and 128′ of the flaps 66 and 66′ are firmly grasped between the fold-in portions 94, 96 and 94′ and 96′ and the end bottom panels 70 and 70′ to thus securely hold the end bottom panels 70 and 70′ to the flaps 66 and 66′.

This grasping of the opposite flap within the bellows fold helps to strengthen the outer bottom end at the score lines 78 and 78' to substantially further increase the strength of the container.

Further having the end bottom panels 70 and 70' on top when the container is upright results in the folds of partial bellows bottom not being exposed inside of the container; this together with the tight securement of the end bottom panels 70 and 70' to the bottom panels 66 and 66' substantially reduces trapping of material in the folds or under flaps in the bottom of the container.

The reinforcement of the outside corners of the end bottom edges of the container enhances the reinforcement of the junction between the cells 20 and 22 and the panels 44 and 44' to prevent the cells from being torn apart by the forces of the bulk material since the elimination or reduction of rounding of the outer corners and bottom edges reduces the forces tending to tear the cells apart. Similarly the reduction in the rounding of the outer corners and the bottom end edges enhances the improved strength of the container to withstand stacking forces and particularly the strength provided by the third thickness of paperboard contributed by the inside joint flaps 58 and 58'.

It is noted that the bottom panels 66, 68, 70 and 72 being on the outer sleeve 40 cross over the bottom edges of the liner 42 to further improve the resistance of the bottom end of the container to sifting out of the materials through the corners in addition to that provided by the partial bellows bottom. The bottom panels 66, 68, 70 and 72 being on the sleeve 40, also make it easier to set up and knock down the container body.

Since many variations, modifications and changes in detail may be made to the described embodiment, it is intended that all matter in the foregoing description and accompanying drawings be interpreted as illustrative and not in a limiting sense.

What is claimed is:

1. A bottom for a bulk container having at least one cell with four side walls circumscribing the one cell, the bottom comprising three bottom panels hinged at horizontal score lines on the bottom edges of three of the four walls forming an end bottom panel and two side bottom panels on opposite sides of the end bottom panels, the two side bottom panels of said three bottom panels being hinged to the opposite sides of the end bottom panel of said three bottom panels by vertical score lines, said two side bottom panels having respective partial diagonal score lines extending at one end from the respective corners defined by the vertical and horizontal score lines, said two side bottom panels further having respective cuts extending from the distal edges of the side bottom panels to the other ends of the partial diagonal score lines such as to form partial bellows corners at the bottom end of the bulk container, a fourth bottom panel hinged on the bottom edge of the fourth side wall and free of the three bottom panels, said fourth bottom panel being sandwiched between the end bottom panel and fold-in portions defined by the partial diagonal score lines and cuts with the end bottom panel on top of the fourth bottom panel as the container sits upright, and said end bottom panel and said fourth bottom panel each extending more than one half but substantially less than all the distance across the bottom whereby together the end bottom panel and fourth bottom panel cover the bottom.

2. A bottom for a bulk container as claimed in claim 1 wherein the partial diagonal score line extends less than 40% of the width across the two side bottom panels.

3. A bottom for a bulk container as claimed in claim 1 wherein the four bottom panels all have equal widths.

4. A bottom for a bulk container as claimed in claim 2 wherein the four bottom panels all have equal widths.

5. A bulk container having at least one cell and the bottom as claimed in claim 1 and further including the four side walls circumscribing the one cell.

6. A bulk container as claimed in claim 5 including a top cap.

7. A bulk container as claimed in claim 5 including a slip sheet.

* * * * *

UNITED STATES PATENT OFFICE

CERTIFICATE OF CORRECTION

Patent No. 4,091,983 Dated May 30, 1978

Inventor(s) Vernard S. Booth; Billy W. Oswalt

It is certified that error appears in the above-identified patent and that said Letters Patent are hereby corrected as shown below:

Column 1, Line 36, delete "petitions" and insert in place thereof -- partitions --.

Column 1, Line 52, delete "2,48,359" and insert in place thereof -- 2,478,359 --.

Column 3, Line 11, delete "lip" and insert in place thereof -- lid --.

Column 4, Line 58, immediately following "88" insert a -- , --.

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*